US006554267B2

(12) United States Patent
Trovinger

(10) Patent No.: US 6,554,267 B2
(45) Date of Patent: Apr. 29, 2003

(54) STAPLING APPARATUS FOR A BOOKLET MAKER

(75) Inventor: Steven W Trovinger, Los Altos, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 96 days.

(21) Appl. No.: 09/820,743

(22) Filed: Mar. 30, 2001

(65) Prior Publication Data

US 2002/0140154 A1 Oct. 3, 2002

(51) Int. Cl.[7] ..... B42C 1/00

(52) U.S. Cl. ..... 270/52.18; 270/58.08; 270/52.26; 227/155; 412/6; 412/33

(58) Field of Search ..... 270/52.18, 52.26, 270/58.07, 58.08, 58.1; 227/155; 412/6, 33, 35

(56) References Cited

U.S. PATENT DOCUMENTS

| | | | | |
|---|---|---|---|---|
| 1,911,159 A | * | 5/1933 | Metcalf | 227/155 |
| 3,747,824 A | * | 7/1973 | Linden | 112/21 |
| 3,797,419 A | * | 3/1974 | Depetris | 112/21 |
| 4,196,835 A | * | 4/1980 | Schlough | 227/81 |
| 4,221,373 A | | 9/1980 | Muller Hans | |
| 4,236,706 A | * | 12/1980 | Schlough | 270/52.18 |
| 4,484,501 A | | 11/1984 | Ramcke | |
| 4,522,383 A | * | 6/1985 | Macey | 227/101 |
| 4,575,296 A | | 3/1986 | Kockler et al. | |
| 4,595,187 A | | 6/1986 | Bober | |
| 4,792,077 A | | 12/1988 | Faltin | |
| 4,795,071 A | | 1/1989 | Jacobs et al. | |
| 5,028,193 A | | 7/1991 | Misicka | |
| 5,100,118 A | * | 3/1992 | Hobbs et al. | 270/52.17 |
| 5,377,965 A | | 1/1995 | Mandel et al. | |
| 5,632,587 A | | 5/1997 | Coyette | |
| 5,662,318 A | | 9/1997 | Harada et al. | |
| 5,772,195 A | | 6/1998 | Mueller | |
| 5,803,891 A | | 9/1998 | Haan et al. | |
| 5,806,750 A | * | 9/1998 | Yamanushi et al. | 227/131 |
| 6,099,225 A | * | 8/2000 | Allen et al. | 412/1 |
| 6,142,353 A | | 11/2000 | Boss | |

FOREIGN PATENT DOCUMENTS

| | | |
|---|---|---|
| WO | WO 00/18583 | * 4/2000 |

OTHER PUBLICATIONS

U.S. patent application No. 09/820,742 to Steven W. Trovinger et al.
U.S. patent application No. 09/820,739 to Steven W. Trovinger et al.
U.S. patent application No. 09/820,741 to Steven W. Trovinger et al.
U.S. patent application No. 09/820,740 to Steven W. Trovinger.

* cited by examiner

*Primary Examiner*—Patrick H. Mackey

(57) ABSTRACT

A stapling apparatus for a booklet maker is described which provides a compact and low cost booklet maker for desktop publishing. The stapling apparatus includes a sheet receiving saddle for receiving sheets to be stapled into a booklet. A plurality of staple clinch units are arranged along the spine of the saddle. A single movable stapler head moves along the saddle to the plurality of clinch units to staple a booklet.

19 Claims, 7 Drawing Sheets

STAPLING APPARATUS FOR A BOOKLET MAKER

BACKGROUND OF THE INVENTION

1. Field of the Invention

The invention relates to a stapling apparatus, and more particularly, the invention relates to a stapling apparatus with a movable stapler unit for a booklet maker.

2. Brief Description of the Related Art

Automated saddle stitch booklet makers are currently used to bind many sheets of duplex printed material into a finished booklet. The currently known booklet making machines perform operations such as stapling, folding, and booklet trimming. Generally these booklet making machines perform these functions on all sheets in a booklet, simultaneously requiring high forces, powerful motors, and dangerous cutting devices. Such booklet making machines are expensive, often exceeding the cost of desktop or office printers. As such, known booklet making machines are not well suited for use in low cost desktop booklet making.

Accordingly, there is a need for electronic desktop publishing machines for forming booklets which are compact, low cost, high quality and suitable for use with desktop laser and ink jet printers.

Most automated booklet makers use multiple stapling units placed at fixed positions to staple the booklet simultaneously. Typically, booklet makers include two or three complete staple units. These staple units may be movable for creation of different size booklets. However, these staple units are typically movable only by manual means and may be repositioned manually to accommodate a different size booklet. This greatly limits the flexibility of these booklet makers to make booklets of different sizes.

U.S. Pat. No. 4,595,187 describes a low cost on-line saddle stapler accessory for preparing booklets in which a single staple unit is used. With this stapler, a set of sheets is compiled on a roof shaped tray having a fixed stapler and passive anvil. The stapler is actuated to engage the passive clinch anvil of the stapler to form the first of two staples. The stack of sheets is then moved to a second position and the stapler is again actuated to engage the passive clinch anvil making the second staple. This solution provides a less expensive booklet maker using only a single stapler instead of multiple staplers. However, this apparatus is unnecessarily large due to the need to slide the entire booklet sideways during stapling to form the second staple.

Accordingly, it would be desirable to provide an automated saddle stitch booklet maker having a movable staple head unit and multiple fixed clinch mechanisms.

SUMMARY OF THE INVENTION

The present invention relates to a stapling apparatus for a booklet maker having a single movable stapler head cooperating with a plurality of active clinch units.

In accordance with one aspect of the present invention, a stapling apparatus includes a sheet receiving saddle having a spine for receiving sheets to be stapled into a booklet, a single stapler head movable in a direction parallel to the spine of the sheet receiving apparatus, and a plurality of active clinch units positioned along the spine of the sheet receiving saddle.

In accordance with an additional aspect of the present invention, a stapling apparatus includes a sheet receiving member for receiving sheets to be stapled into a booklet, a plurality of active clinch units positioned substantially in a line on the sheet receiving member, and a movable stapler head arranged to deliver a staple at each of the plurality of active clinch units.

In accordance with a further aspect of the invention, a method of stapling a booklet includes the steps of arranging a plurality of sheets on a sheet receiving apparatus, wherein the sheet receiving apparatus includes a plurality of active clinch units, and moving a stapler head along the sheet receiving apparatus to staple the sheets at the multiple active clinch units.

The present invention provides advantages of a more compact and less expensive stapling apparatus for use in a desktop booklet making apparatus.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1:
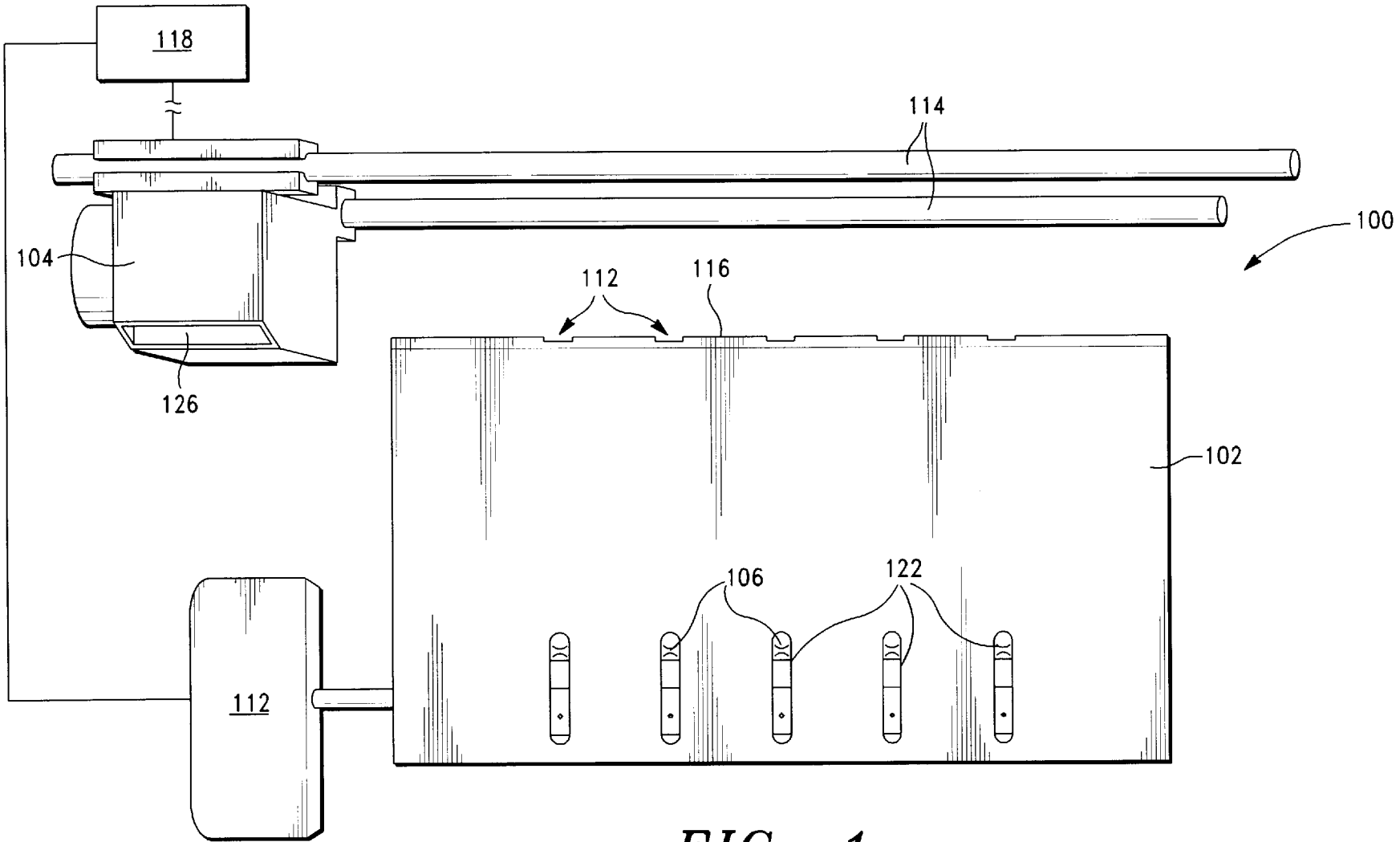
FIG. 1 is a side view of a stapling apparatus according to the present invention.

FIG. 1 illustrates a stapling apparatus 100 including a sheet receiving saddle 102 and a movable stapler head 104. The stapler head 104 is movable along a spine 116 of the saddle 102 for stapling a booklet at multiple clinch locations 120. Each of the clinch locations 120 on the saddle 102 is provided with an active clinch unit 106 which is partially visible through the windows 122 in FIG. 1 and will be discussed in further detail below with respect to FIGS. 5 and 6. The stapling apparatus 100, shown in FIG. 1, allows a single movable stapler head 104 to staple booklets of varying sizes with appropriately spaced staples unique for each booklet size. This allows for a more flexible and lower cost booklet maker.

The stapler head 104 may be any of those automatic stapler heads which are available for use with a corresponding active clinch unit 106. The stapler head 104 is mounted on two rails 114 for movement along the spine 116 of the sheet receiving saddle 102. The stapler head 104 is moved along the rails 114 in a known manner and is controlled by a controller 118.

According to one preferred embodiment of the invention, the multiple active clinch units 106 are operated simultaneously by a single clinch motor 112. The operation of the stapler head 104 and the active clinch units 106 are controlled in a synchronized manner by the controller 118.

Figure 2:
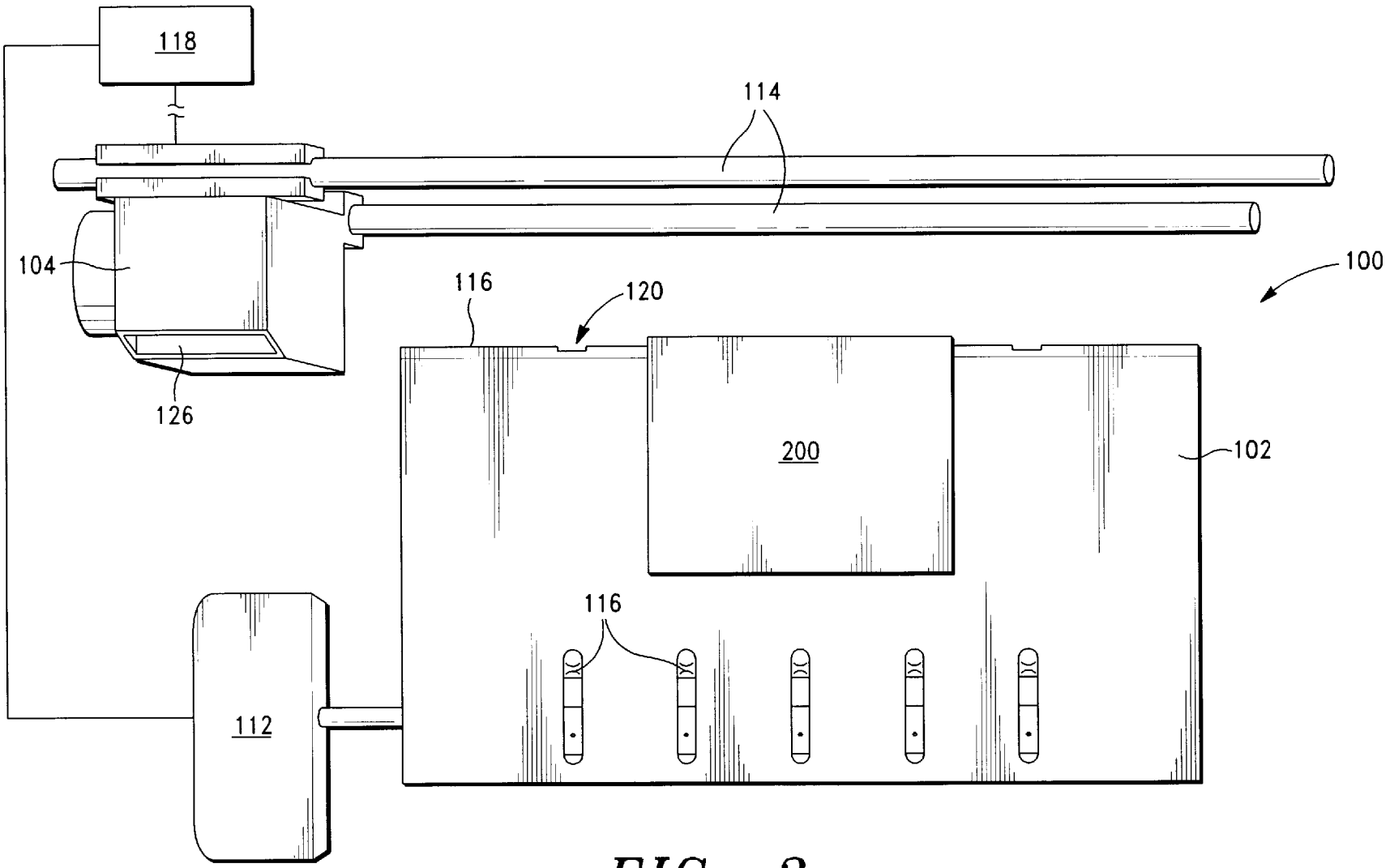
FIG. 2 is a side view of the stapling apparatus of FIG. 1 with a small booklet positioned on the saddle.
Figure 3:
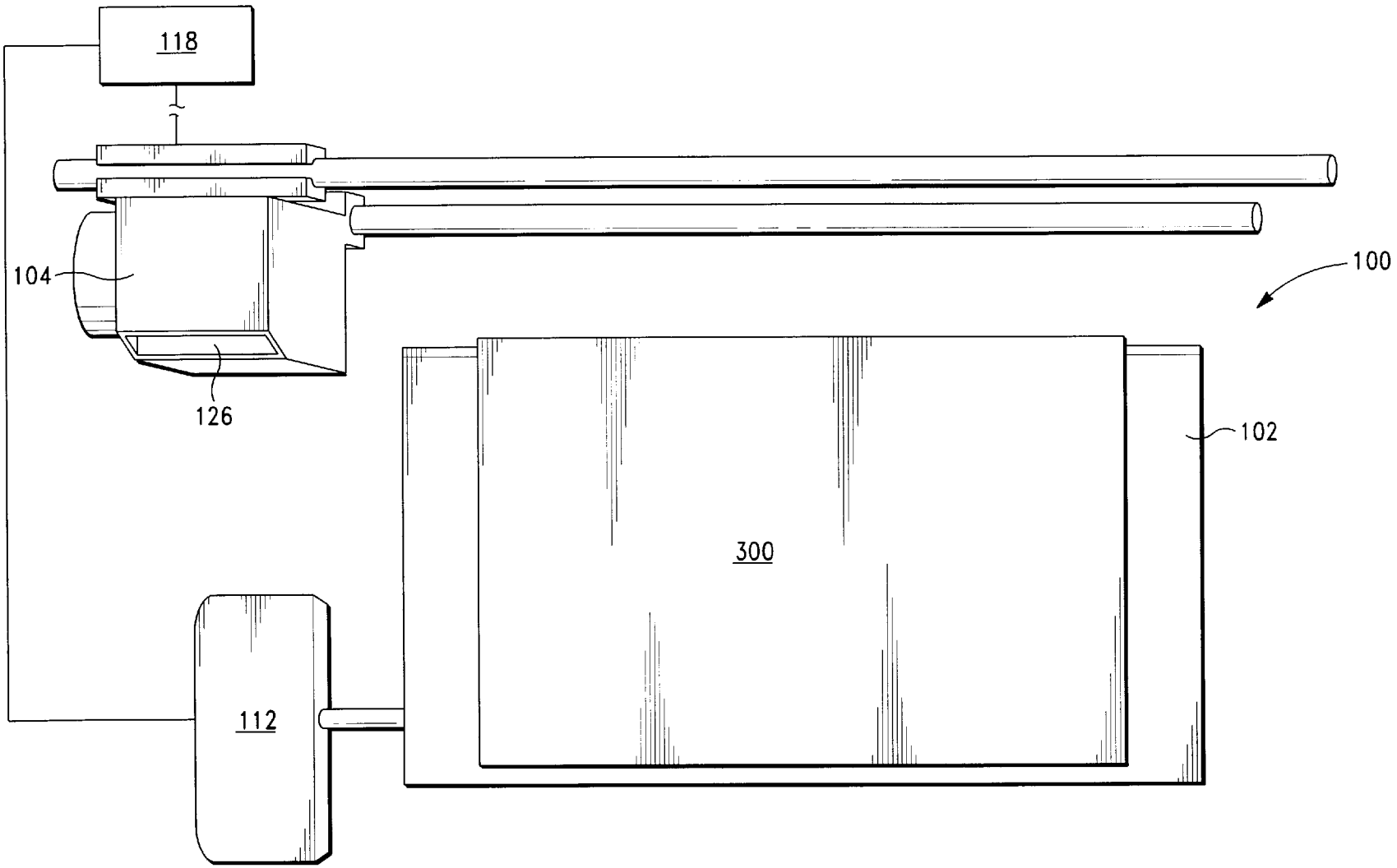
FIG. 3 is a side view of the stapling apparatus of FIG. 1 with a large booklet positioned on the saddle.

FIGS. 2 and 3 illustrate the use of the stapling apparatus 100 for stapling of small and large booklets. As shown in FIG. 2, a small booklet 200 formed of multiple folded sheets is arranged over the sheet receiving saddle 102 with a fold of the sheets arranged along the spine 116 of the saddle 102. The sheets may be delivered to the saddle 102 by the aligning, trimming, punching and/or folding stations of a booklet maker in a known manner. For example, the sheets may be delivered in a manner described in U.S. Pat. No. 6,099,225 or PCT No. WO 00/18583 which are incorporated herein by reference in their entirety.

The small booklet 200 of FIG. 2 is stapled by moving the stapler head 104 to the second of the clinch units 106 and stapling the booklet a first time. The stapler head 104 is then moved to a fourth of the clinch locations to staple the small booklet 200 a second time. According to one preferred embodiment of the invention, five clinch locations 120 are positioned to allow the single stapling apparatus 100 to staple booklets having sizes from about 4 inches to about 11 inches along the spine. However, other numbers of clinch locations 120 may be used for other booklet sizes. According to one preferred embodiment, the clinch locations 120 are spaced apart about 1.5 to about 2 inches on center. However, closer spacing may be preferred for additional stapling choices.

FIG. 3 illustrates the stapling apparatus 100 with a large booklet 300 positioned over the sheet receiving saddle 102. The large booklet 300 is stapled at three stapling locations 120 along the spine 116.

According to one embodiment of the invention, when a fold in the sheets has a length of about 8.5 inches or less, a booklet having two staples is formed. When a fold in the sheets has a length of more than about 8.5 inches, a booklet having three staples is formed. Other examples of common booklet sizes are booklets having a fold length of about 11 inches with three staples and CD Rom size booklets having a fold length of about 4 inches with two staples.

Figure 4:
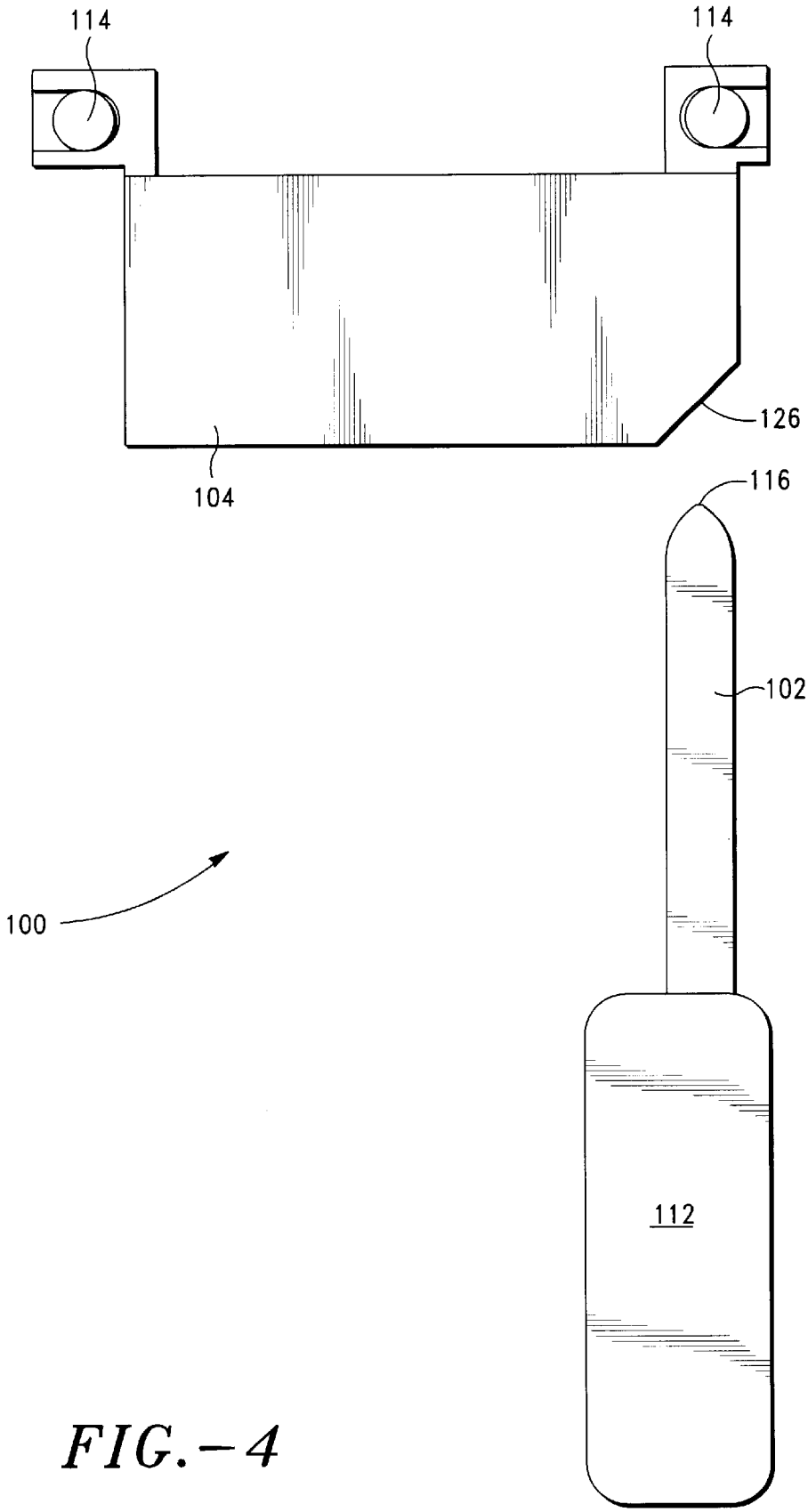
FIG. 4 is a end view of the stapling apparatus of FIG. 1.

FIG. 4 is an end view of the stapling apparatus 100 illustrating the pointed shape of the upper end of the sheet receiving saddle 102 and the positioning of the stapler head 104 with a stapling portion 126 aligned directly over the spine 116 of the saddle.

Figure 5:
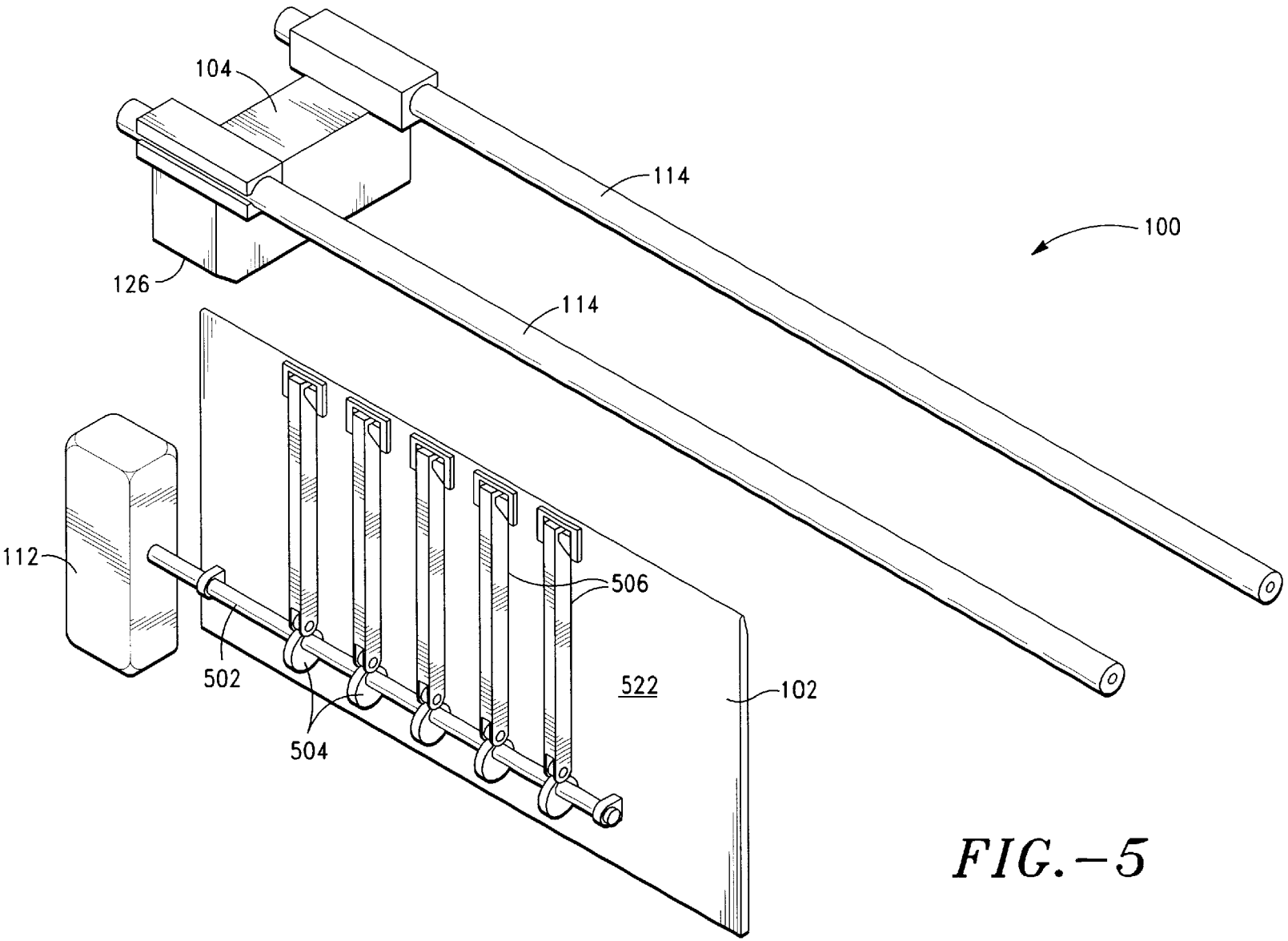
FIG. 5 is a perspective view of the stapling apparatus of FIG. 1 with one-half of the saddle cover removed to expose the clinch mechanisms.
Figure 6:
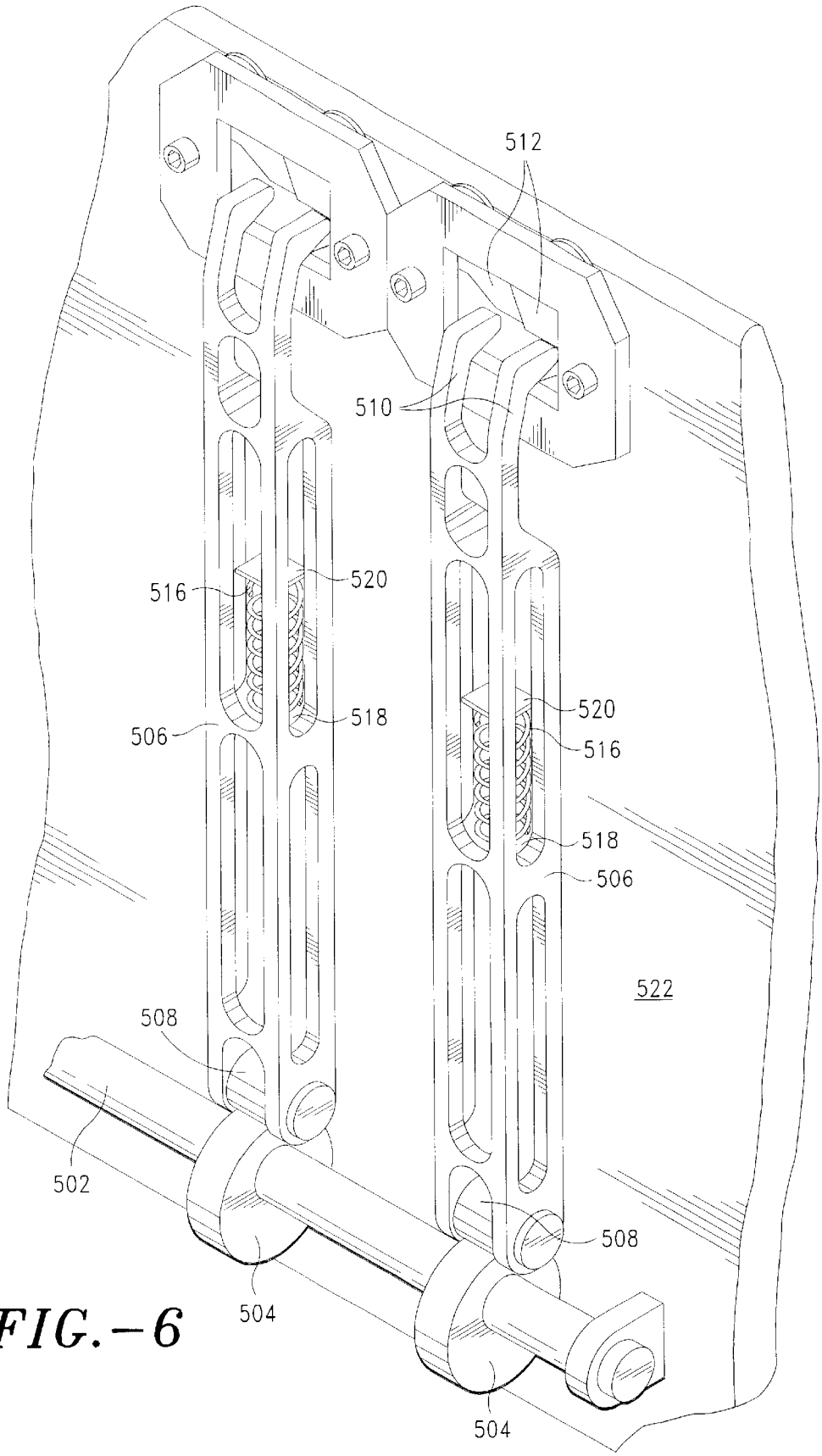
FIG. 6 is an enlarged prospective view of two of the clinch mechanisms of FIG. 5.

The active clinch units 106 will now be described with reference to FIGS. 5 and 6. As shown in FIG. 5, the clinch motor 112 is provided with a drive shaft 502 on which five clinch cams 504 are mounted. Positioned above each of the clinch cams 504 is a corresponding push rod 506. Each push rod 506, as shown in FIG. 6, includes a roller 508 at a lower end and two lift pins 510 at an upper end. The lift pins 510 operate to lift and rotate clinch plates 512 which function to fold over the ends of the staples (not shown). The operation and structure of the clinch plates 512 for folding over the ends of the staples may be performed according to the manners known in the art. The push rods 506 also each include a return spring 516 which is positioned between a plate 518 on the push rod and a plate 520 extending from the saddle plate 522 on which the push rods 506 are mounted. Accordingly, the return spring 516 returns the push rod 506 to a lowered position after clinching of the staple has been performed.

In operation of the stapling apparatus 100 according to the present invention, multiple folded sheets are arranged on the sheet receiving saddle 102. The controller 118 determines the number and arrangement of staples to be applied based on a size of the sheets. Alternatively, the number and arrangement of the staples may be input manually. The controller 118 then moves the stapler head 104 to a first stapling position and activates the stapler head 104 and the clinch motor 112 in a synchronized manner to perform a first stapling operation.

The rotation of the single clinch motor 112 drives all of the active clinch units 106 at once as follows. The clinch motor 112 rotates the drive shaft 502 and the corresponding clinch cams 504 to move the push rods 506 against the bias of the return spring 516. The lift pins 510 on the push rod 506 cause the clinch plates 512 to rotate and bend over the ends of the staple. The clinch motor 112 continues to rotate the clinch cams 504 until the clinch cams return to the initial position illustrated in FIGS. 5 and 6 and the push rods 506 are returned to their lowered positions by the return springs 516.

The stapler head 104 is then moved to a next staple location and the stapling process is repeated. The number of staples applied to the booklet depend on the size of the booklet being formed.

Figure 7:
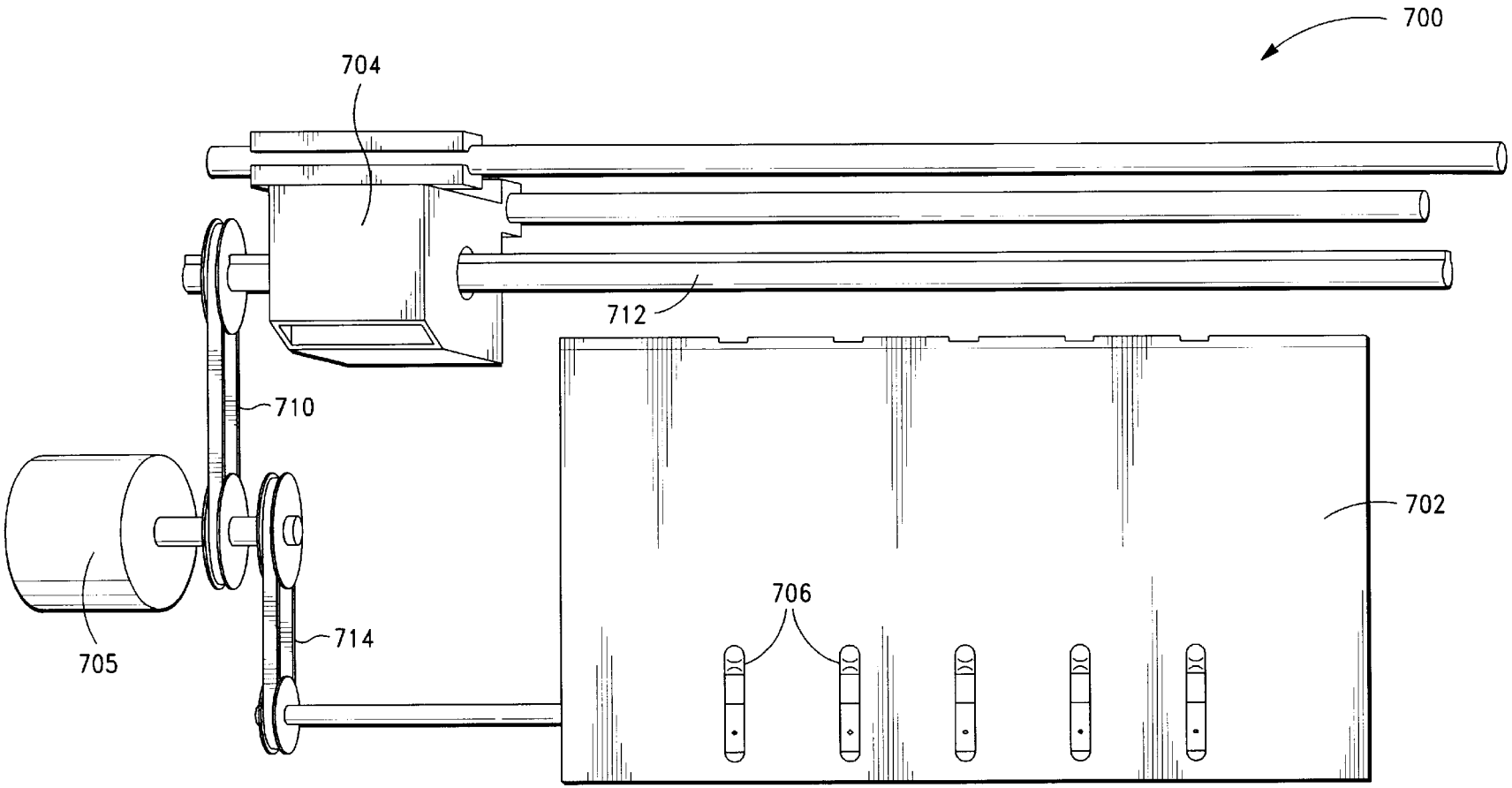
FIG. 7 is a side view of a stapling apparatus according to an alternative embodiment of the invention.

FIG. 7 illustrates an alternative embodiment of a stapling apparatus 700 in which the stapler head 704 and the multiple active clinch units 706 of the sheet receiving saddle 702 are operated by a single motor 705. The motor 705 drives the stapler head 704 by way of a transmission member 710 such as a belt and a splined rotating shaft 712. The motor 705 drives the multiple active clinch units 706 by a second transmission member 714. The system may also be provided with appropriate gear boxes as necessary.

The stapling apparatus 100 according to the present invention provides a unique low cost stapling apparatus for a booklet maker due to the use of a single stapler head 104 and a single clinch motor 112. Since the stapler head 104 is a high cost item, the use of a single stapler head lowers the cost of the booklet maker substantially. In addition, the stapling apparatus 100 is convenient for customers to use because a single stapler head 104 means that there is only one place for the customer to refill staples. In addition, the possibility of separate stapler heads running out of staples at different times is eliminated.

An additional advantage of the design of the stapling apparatus 100 according to the present invention is that stapling is performed on sheets which have already been folded. This ability is provided by the fact that the clinch locations 120 are very narrow and can be located within the fold of a folded sheet. This allows the design of the entire stapling apparatus to be more compact and allows the folds to be made in the sheets prior to stapling. Folding of the single sheets requires less force than folding of a stack of sheets.

Although the present invention has been described as employing a plurality of fixed clinch units 106, it should be understood that the clinch units may also be movable. In addition, although the clinch units 106 are preferably activated by a single clinch motor 112, the invention may also include multiple clinch motors 112 or a passive clinch mechanism.

The present invention may be used for stapling booklets and may also be used for side stapling of stacked sheets. The booklet maker, including the stapling apparatus, may be a stand alone unit or may be connected to or incorporated in a printer or copier system.

While the invention has been described in detail with reference to the preferred embodiments thereof, it will be apparent to one skilled in the art that various changes and modifications can be made and equivalents employed, without departing from the present invention.

What is claimed is:

1. A stapling apparatus comprising:

a sheet receiving saddle having a spine for receiving sheets to be stapled into a booklet;

a single stapler head movable in a direction parallel to the spine of the sheet receiving apparatus; and a plurality of active clinch units positioned along the spine of the sheet receiving saddle, wherein the single stapler head is sequentially positioned over each of the active clinch units.

2. The stapling apparatus of claim 1, further comprising a controller for activating the stapler head and the clinch units in a synchronized manner.

3. The stapling apparatus of claim 1, wherein the plurality of active clinch units are operated by a common clinch motor.

4. The stapling apparatus of claim 3, wherein the plurality of active clinch units are operated simultaneously.

5. The stapling apparatus of claim 1, wherein the stapler head is movable along at least one rail positioned parallel to the spine of the sheet receiving saddle.

6. The stapling apparatus of claim 1, wherein the plurality of active clinch units each include movable push rods for rotating clinch plates.

7. The stapling apparatus of claim 6, wherein the push rods are activated by clinch cams which are mounted on a drive shaft of a clinch motor.

8. The stapling apparatus of claim 7, wherein the push rods are provided with return springs for returning the push rods to an initial position.

9. The stapling apparatus of claim 1, wherein the stapler head and the plurality of active clinch units are operated by a common motor.

10. A stapling apparatus comprising:

a sheet receiving member for receiving sheets to be stapled into a booklet;

a plurality of active clinch units positioned substantially in a line on the sheet receiving member; and a single movable stapler head arranged to deliver a staple at each of the plurality of active clinch units.

11. The stapling apparatus of claim 10, further comprising a controller for activating the stapler head and the clinch units in a synchronized manner.

12. The stapling apparatus of claim 10, wherein the plurality of active clinch units are operated by a common clinch motor.

13. The stapling apparatus of claim 10, wherein the sheet receiving member is a saddle including a spine for receiving folded sheets and the stapler head is movable along a line substantially parallel to the spine of the sheet receiving saddle.

14. The stapling apparatus of claim 10, wherein the stapler head and the plurality of active clinch units are operated by a common clinch motor.

15. A method of stapling a booklet comprising:

arranging a plurality of sheets on a sheet receiving apparatus, wherein the sheet receiving apparatus includes a plurality of active clinch units; and moving a single stapler head along the sheet receiving apparatus to staple the sheets at each of the active clinch units.

16. The method of claim 15, wherein the plurality of sheets are folded before being arranged on the sheet receiving apparatus.

17. The method of claim 16, wherein when a fold in the sheets has a length of about 8½ inches or less, a booklet having two staples is formed.

18. The method of claim 16, wherein when a fold in the sheets has a length of about 8½ inches or more, a booklet having three staples is formed.

19. The method of claim 15, wherein the stapler and active clinch units are activated in a synchronized manner by a controller.

* * * * *